US011479934B2

(12) United States Patent
Gerrard et al.

(10) Patent No.: US 11,479,934 B2
(45) Date of Patent: Oct. 25, 2022

(54) SURFACE MOUNT SECURITY BARRIER

(71) Applicants: Robert Gerrard, Coventry (GB); Marcus Gerrard, Coventry (GB)

(72) Inventors: Robert Gerrard, Coventry (GB); Marcus Gerrard, Coventry (GB)

(73) Assignee: GME SPRINGS LIMITED, Coventry (GB)

( * ) Notice: Subject to any disclaimer, the term of this patent is extended or adjusted under 35 U.S.C. 154(b) by 167 days.

(21) Appl. No.: 16/640,389

(22) PCT Filed: Aug. 30, 2018

(86) PCT No.: PCT/EP2018/073411

§ 371 (c)(1),
(2) Date: Feb. 20, 2020

(87) PCT Pub. No.: WO2019/043132

PCT Pub. Date: Mar. 7, 2019

(65) Prior Publication Data

US 2020/0354908 A1 Nov. 12, 2020

(30) Foreign Application Priority Data

Sep. 1, 2017 (GB) ..... 1714029
Dec. 13, 2017 (GB) ..... 1720795

(51) Int. Cl.
*E01F 15/08* (2006.01)
*E01F 15/14* (2006.01)
(Continued)

(52) U.S. Cl.
CPC ..... *E01F 15/146* (2013.01); *E01F 13/12* (2013.01); *E01F 15/083* (2013.01);
(Continued)

(58) Field of Classification Search
CPC ..... E01F 15/083; E01F 15/085; E01F 15/088; E01F 15/146; E01F 13/12; F41H 11/08
(Continued)

(56) References Cited

U.S. PATENT DOCUMENTS 817,282 A * 4/1906 Stewart ..... E04H 1/00 256/13.1
4,806,044 A 2/1989 Duckett
(Continued)

FOREIGN PATENT DOCUMENTS

CA 2364937 A1 6/2003
DE 9301089 U1 3/1993
(Continued)

OTHER PUBLICATIONS

Australia Examination Report issued by IP Australia in connection with Australian Patent Application No. 2018322836 dated Feb. 11, 2021.

(Continued)

*Primary Examiner* — Raymond W Addie
(74) *Attorney, Agent, or Firm* — Levenfeld Pearlstein, LLC

(57) ABSTRACT

A security barrier includes a plurality of barrier islands. Each barrier island has a concrete crash block having at least one pair of opposing side faces and external fixing elements on the opposing side faces. Attachments, which may be flexible attachments, extend between the external fixing elements of adjacent barrier islands of the security barrier. Each barrier island also has one or more load transfer element within the concrete crash block and, under load, the load transfer elements transfer load from the external fixing elements on one side of the concrete crash block to the external fixing elements on the opposing side of the concrete crash block.

19 Claims, 13 Drawing Sheets

(51) Int. Cl.
*E01F 13/12* (2006.01)
*F41H 11/08* (2006.01)

(52) U.S. Cl.
CPC ..... *E01F 15/085* (2013.01); *E01F 15/088* (2013.01); *F41H 11/08* (2013.01)

(58) Field of Classification Search
USPC ..... 404/6; 256/13.1
See application file for complete search history.

(56) References Cited

U.S. PATENT DOCUMENTS 5,156,485 A * 10/1992 Ivey ..... E01F 15/0476 256/13.1
5,605,413 A * 2/1997 Brown ..... E01F 15/025 256/13.1
5,938,370 A * 8/1999 Gzybowski ..... E01F 15/083 404/9
6,474,904 B1 11/2002 Duckett et al.
7,104,721 B2 * 9/2006 Rogers ..... E01F 13/06 104/35
7,416,364 B2 * 8/2008 Yodock, III ..... E01F 15/083 256/13.1
7,654,768 B1 2/2010 Tullis et al.
7,699,558 B2 * 4/2010 Adler ..... E01F 9/685 404/6
7,775,738 B2 * 8/2010 Darcy ..... E01F 13/12 404/6
8,206,056 B2 * 6/2012 O'Banion ..... E01F 15/025 404/6
8,388,257 B2 * 3/2013 Redlberger ..... E01F 15/083 404/6
8,523,479 B2 * 9/2013 Adler ..... E01F 13/12 404/6
8,545,126 B1 * 10/2013 Alsaffar ..... E01F 15/086 404/6
8,657,526 B2 * 2/2014 Withers ..... E01F 13/048 404/6
8,985,891 B1 * 3/2015 Sharp ..... E01F 15/02 404/6
2003/0190189 A1 * 10/2003 Roller ..... E01F 15/0469 404/6
2006/0018711 A1 * 1/2006 Rogers ..... E01F 13/12 404/6
2009/0060650 A1 * 3/2009 Kulp ..... E01F 15/088 404/6
2011/0070022 A1 * 3/2011 Dandy ..... E01F 13/12 404/6
2011/0081200 A1 * 4/2011 Lamore ..... H02G 9/00 404/6
2011/0293366 A1 * 12/2011 Gerrard ..... E01F 15/0476 404/6
2013/0284002 A1 * 10/2013 White ..... F41H 11/00 89/36.01
2014/0008595 A1 * 1/2014 O'Banion ..... E01F 15/06 404/6
2014/0010591 A1 * 1/2014 Ball ..... E01F 15/003 404/6
2015/0218763 A1 * 8/2015 Smith ..... E01F 15/083 404/6
2016/0194841 A1 * 7/2016 Sicking ..... E01F 15/146 404/6
2019/0330812 A1 * 10/2019 Ptacek ..... E01F 9/692

FOREIGN PATENT DOCUMENTS

DE 102006053341 A1 5/2008
DE 102010018843 A1 11/2011
EP 0844335 A1 5/1998
FR 2610338 A1 8/1988
GB 2511273 A 9/2014
JP 2001164530 A 6/2001
WO 2013033766 A1 3/2013
WO 2014083336 A1 6/2014
WO 2015033100 A1 3/2015

OTHER PUBLICATIONS

International Search Report issued by ISA/EPO in connection with PCT/EP2018/073411 dated Nov. 9, 2018.
GB Search Report issued by IPO in connection with GB1714029.4 dated Feb. 23, 2018.
GB Search Report issued by IPO in connection with GB1720795.2 dated Feb. 23, 2018.
GB Search Report issued by IPO in connection with GB1814143.2 dated Feb. 15, 2019.

* cited by examiner

SURFACE MOUNT SECURITY BARRIER

This is a National Stage Application of International Patent Application No. PCT/EP2018/073411, filed Aug. 30, 2018, which claims the benefit of and priority to Great Britain (GB) Patent Application Nos. 1714029.4, filed Sep. 1, 2017, and 1720795.2, filed Dec. 13, 2017, the entireties of which are incorporated fully herein by reference.

TECHNICAL FIELD

The present disclosure relates to a surface mount security barrier, in particular to a surface mount security barrier for preventing or retarding vehicular passage.

BACKGROUND

With the increasing incidence of terror attacks using the weaponization of vehicles by driving them at crowded pedestrian areas, there is an increasing need for barriers that prevent or hamper vehicular passage.

In general, security barriers, or crash barriers, the main purpose of which is to prevent the passage of vehicles, are widely known in the art and have many applications. Common applications are for bordering dangerous sections of roads, providing a central separation between lanes of traffic moving in opposite directions, and around secure areas, for example around the entrance to airports or the like.

Such barriers generally include some form of underground footing which is either integral with an above ground section of the barrier, or to which an above ground section of the barrier is attached. While these provide an adequate solution for permanent areas of risk where the cost and disruption of installing them is justified, they do not provide a good solution where a temporary measure is needed. Examples of where a temporary measure may be needed are at intended permanent sites prior to the installation of a permanent solution and at seasonal or short-term events, for example music festivals, Christmas markets or the like.

Some solutions such as concrete blocks which can be manoeuvred into location are used, however these are generally not effective against anything apart from slow moving light weight vehicles and do not meet the requirements of standards such as the BSI IWA14.2013 collision test, in particular existing such blocks when impacted by, for example a 7 tonne truck travelling at 48 kph (30 mph) will be propelled considerable distances at high speed. In a crowded environment such as a Christmas market or a music festival these bollards can cause significant damage. In addition, if these exiting blocks are hit on the corner they tend to spin and are ineffective at hindering the passage of a vehicle.

It is an aim of the present invention to provide an effective security barrier that can easily be placed on top of the existing ground surface at a required location without the need for any excavation or specific surface preparation.

SUMMARY OF THE INVENTION

According to an aspect of the present invention there is provided a surface mount security barrier comprising: a plurality of barrier islands each comprising: a concrete crash block having at least one pair of opposing side faces; external fixing elements at said opposing side faces of the concrete crash block, and one or more load transfer element embedded internally within said concrete crash block; and one or more attachments extending between external fixing elements of adjacent barrier islands. Under load, the load transfer elements transfer load through the concrete crash block from the external fixing elements on one side of said concrete crash block to the external fixing elements on the opposing side of said concrete crash block.

The load transfer elements may be configured such that, when the security barrier is subject to sufficient impact to create tension in said attachments, the load transfer elements transfer load between external fixing elements of a barrier island without imparting a significant tensile load on the concrete crash block. By without imparting a significant tensile load on the concrete crash block what is meant is that, although under impact there will always be some tensile loading on the concrete crash block, the concrete crash block is not required to bear the full load between the external fixing elements in tension, as the tensile load is taken up in the load transfer elements.

A longitudinal axis of each said one or more load transfer element may be substantially parallel to the longitudinal axis of the security barrier. Under impact the load of impact on one barrier island is transferred through the attachments to an adjacent barrier island. As the load transfer elements transfer the load of impact between the attachments the load is transferred through the concrete crash blocks without the concrete blocks assuming any significant tensile loading. As concrete has a relatively low tensile strength this enables the load under impact to be transferred between adjacent barrier islands without risking failure of the concrete crash blocks.

In an embodiment the load transfer elements are attached at either end to a said external fixing element. In this manner the load can be transferred directly as a tensile load through the load transfer element. In an arrangement the load transfer element may comprise one or more nylon strap. In another arrangement the load transfer element may comprise a steel or composite element.

In an arrangement the at least one pair of opposing side faces comprises two pairs of opposing side faces, and the one or more load transfer element extends between external fixing elements on opposing side faces of each pair. In this manner barrier islands maybe arranged perpendicularly to one another such that the barrier can turn a corner.

The attachments may be flexible attachments which, in use, may extend along the ground between said adjacent barrier islands. In this manner the barrier can be arranged to allow pedestrians or small vehicles, e.g. bicycles or motorbikes, to pass between adjacent barrier islands. Under impact, however, the flexible attachments will still provide the transfer of load between adjacent barrier islands.

Optionally the opposing side faces have at least one recess therein and an external fixing element is located in the recess. The opposing side faces may each have two recesses therein and an external fixing element located in each said recess. The recesses may extend vertically along the opposing side faces from a lower edge thereof.

In one arrangement each recess may comprise a U-channel, which may be steel, extending vertically along a said opposing side face from a lower edge thereof, the U-channel embedded in said concrete crash block and opening onto its side face. The external fixing element can extend through the U-channel at a position above said lower edge. In this manner the U-channel provides a reinforced channel extending from the external fixing element towards the ground so that the flexible attachment can extend from the external fixing element, along the reinforced channel to the lower edge, substantially along the ground between adjacent barrier islands, up the opposing U-channel and to the respective external fixing element on the adjacent barrier island.

A pin may be provided that extends across the recess substantially adjacent the lower edge.

A hole can be provided in the U channel and a tube can extend therefrom such that the pin is slidable in the tube through the hole. The flexible attachment may pass behind the pin, thereby retaining it adjacent the lower edge of the side face.

A cover plate can be provided that extends over the recess or recesses. In this way, in use, the external fixing element, and the flexible attachment within the recess, are both hidden from view and protected.

The flexible attachment may comprise any suitable material, in one arrangement it may comprise one or more nylon strap.

A rebar cage may be embedded within the concrete crash block below the surface thereof.

In one embodiment a barrier island may comprise a plurality of feet extending from a bottom surface thereof. Optionally, the feet may be formed as part of the rebar cage and when the barrier island is formed, the feet may project outwardly from a lower surface thereof. The feet may project from the lower surface of the barrier island for a distance of 1 mm to 10 mm. In use, when placed on a hard surface, due to the weight of the barrier island, the feed will, under impact, act as "teeth" and provide very high-pressure contact points which, if the barrier island moves as a result of an impact, will dig into the surface on which it is situated, further impeding the movement of the barrier island.

In an alternative arrangement the security barrier may further comprise an anti-skid plate associated with each barrier island, wherein the anti-skid plate has a plurality of metal feet extending downwardly therefrom. The anti-skid plates may comprise a steel tray in which the associated barrier island is located. The tray may have upstanding sides within which the associated barrier island fits, and a plurality of feet extending downwardly from the plate at a distance of 1 mm to 10 mm. When located in the anti-skid plate the associated barrier island may be retained therein by the application of a grout between the barrier island and the anti-skid plate. Under impact the anti-skid plate will function in the same manner as the projecting feed described above.

In one arrangement the security barrier may comprising metallic ballast within said concrete crash block. This increases the density of the crash block such that its mass can be increased. The mass of the barrier island may be in the range of 7.5 tonnes to 8.5 tonnes and may comprise at least 5.5 tonnes of ballast.

In an embodiment the barrier may further comprise one or more fence post holes extending downwardly into a top surface of each barrier island and/or one or more security post footing extending downwardly into a top surface thereof, said security post footing for receiving, in use, a security post. A fence post may be located in one or more of the fence post holes in adjacent barrier islands, and at least one fence panel may be attached to fence posts of said adjacent barrier islands. Alternatively, or in addition, at least one openable gate attached to said fence posts of adjacent barrier islands. A spring steel security post may be located in the security post footing of adjacent barrier islands to which a further security barrier comprising either one or more flexible barrier or a rigid barrier may be attached so that it extends between the security posts of said adjacent barrier islands. The flexible or rigid barrier may either be permanently attached to said security posts, or be releasable from said security posts to create an openable barrier.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

One or more embodiments of the invention will now be described, by way of example only, with reference to the accompanying drawings, in which.

DETAILED DESCRIPTION

A security barrier, also known as a crash barrier, in accordance with example embodiments of the present invention is described herein with reference to the accompanying FIGS. 1 to 12.

Figure 1:
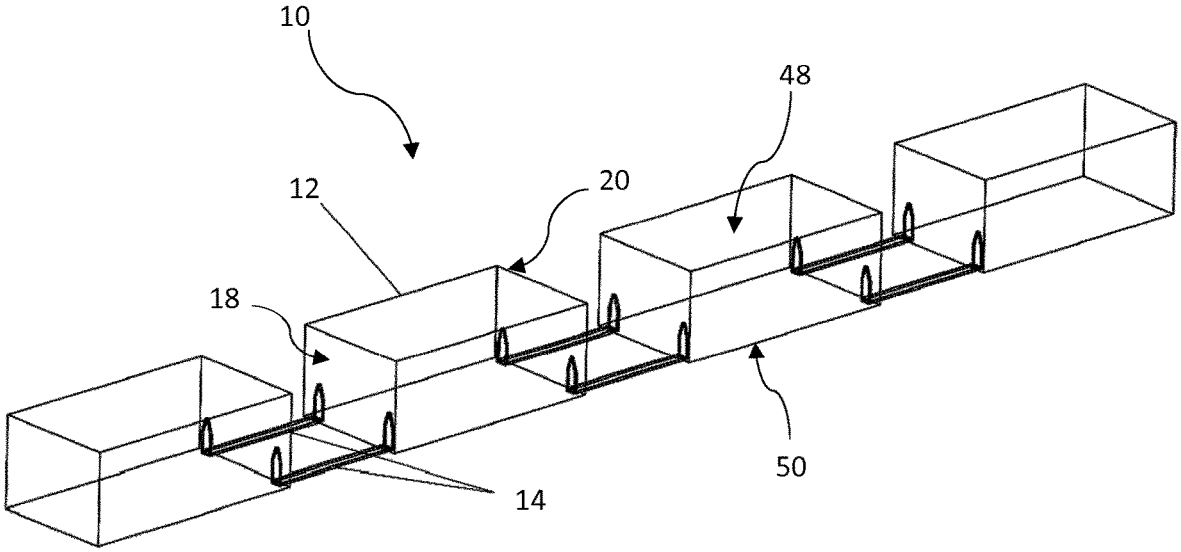
FIGS. 1 and 2 show perspective views of security barriers of the invention.
Figure 2:
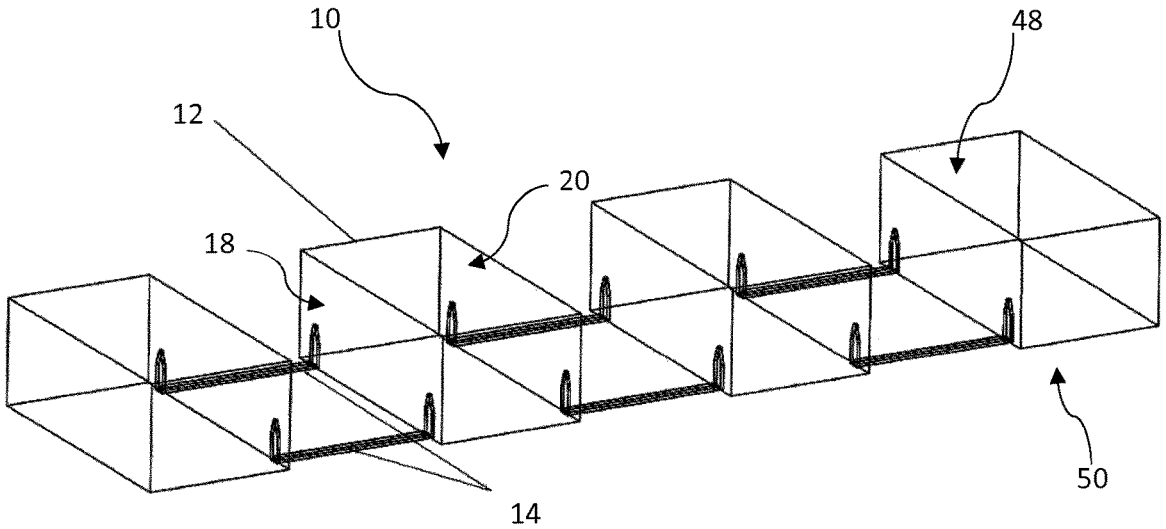

With reference to FIGS. 1 and 2 a surface mount security barrier 10 is shown. The security barrier 10 has a plurality of barrier islands 12 which are described in more detail below. Joining each barrier island are flexible attachments 14 which extend between external fixing elements (see below) of the adjacent barrier islands 12. As shown in FIGS. 1 and 2 two flexible attachments 14 extend between adjacent barrier islands, however it will be appreciated that fewer of more such flexible attachments may be used and the scope to allocate an appropriate number will be within the ability of the skilled person. It will also be appreciated that, if it is not important for the attachments to be located at ground level that non-flexible attachments may be used to connect adjacent barrier islands.

In the embodiments of FIGS. 1 and 2 the barrier islands 12 are substantially rectangular in shape, however it will be appreciated that the invention may have any suitable shape. The carrier island can optionally have chamfered or radiused edges which assists in preventing damage to the corners thereof in transit, lifting and lowering. In the example embodiment, the dimensions of the barrier islands 12 are 2000 mm long, 1200 mm wide and 870 mm high, and comprises a crash block which is made by casting concrete around an internal structure. Although referred to herein as the "internal structure" it will be understood that not all of the internal structure is fully encased in the cast concrete and the term "internal structure" includes components that are on the surface of, or extend out of the cast concrete. Two holes extend through the barrier islands 12 from one face to the opposite face, which may be covered by cover plates (not shown) in use. The holes form lifting points by which the barrier islands 12 may be lifted. To move or lift the barrier islands 12 the cover plates, if attached, are removed and lifting straps are passed through the holes from one side to the other. The ends of the lifting straps can then be attached to lifting equipment, for example a crane, to manoeuvre the barrier islands 12. Once placed in its intended location the lifting points may be used as attachments to attach seats, benches or other furniture (e.g. planters or bicycle stands) to.

As can be seen in FIGS. 1 and 2 the barrier island may be manufactured in different rectangular orientations. Alternatively, they may be substantially square in plan.

As shown the flexible attachments 14 pass down the side of the barrier islands 12 and across the space between them substantially aligned with the lower surface thereof. In use this means that the flexible attachments 14 run substantially along the surface on which the security barrier 10 is mounted. This allows easy and unimpeded pedestrian access between the barrier islands 12. This allows for the free movement of people past the security barrier 10 while maintaining a high degree of protection against vehicular penetration. Although not shown it will be appreciated that the flexible attachments 14 may be covered during use to prevent them from being a trip hazard. Covers, such as those used to cover cabling that needs to be run along the ground for outdoor events, to eliminate trip hazards, is well known. Where the surface mount security barrier 10 is to be installed in a permanent or semi-permanent location the flexible attachments 14 maybe run between the barrier islands 12 slightly below the surface level so as to eliminate the trip hazard, for example a thin layer of tarmacadam, gravel or other suitable surfacing material that will easily allow the flexible attachment 14 to lift if the security barrier 10 is impacted, could be used.

Under impact, if hit square on, the barrier island will absorb a relatively large impact, however if the impact is too great then a single barrier island 12 without the flexible attachments 14 may skid along the ground as the momentum of the vehicle is transferred to the barrier island. Furthermore, if someone is trying to penetrate a row of bollards with a vehicle they will often aim for the gap between the bollards, even if it is not sufficiently large enough for the vehicle to pass. With surface mount barriers, e.g. rectangular pieces of concrete, the impact occurring on the corners of adjacent ones tends to cause them to spin and move, often allowing the vehicle to pass substantially unimpeded in the created space. In the present invention, when struck in such a manner, the barrier islands 12 may start to spin but as they do so the flexible attachments 14 will pull tight thereby both arresting spin and preventing the gap exceeding the length of the flexible attachments 14. In addition, when the flexible attachments 14 pull tight the load is transferred through each barrier island 12 to adjacent ones, via the flexible attachments 14, via the internal structure of the barrier islands 12 in such a manner as to prevent the full load transfer being applied to the cast concrete as a tensile load thereon.

Figure 3:
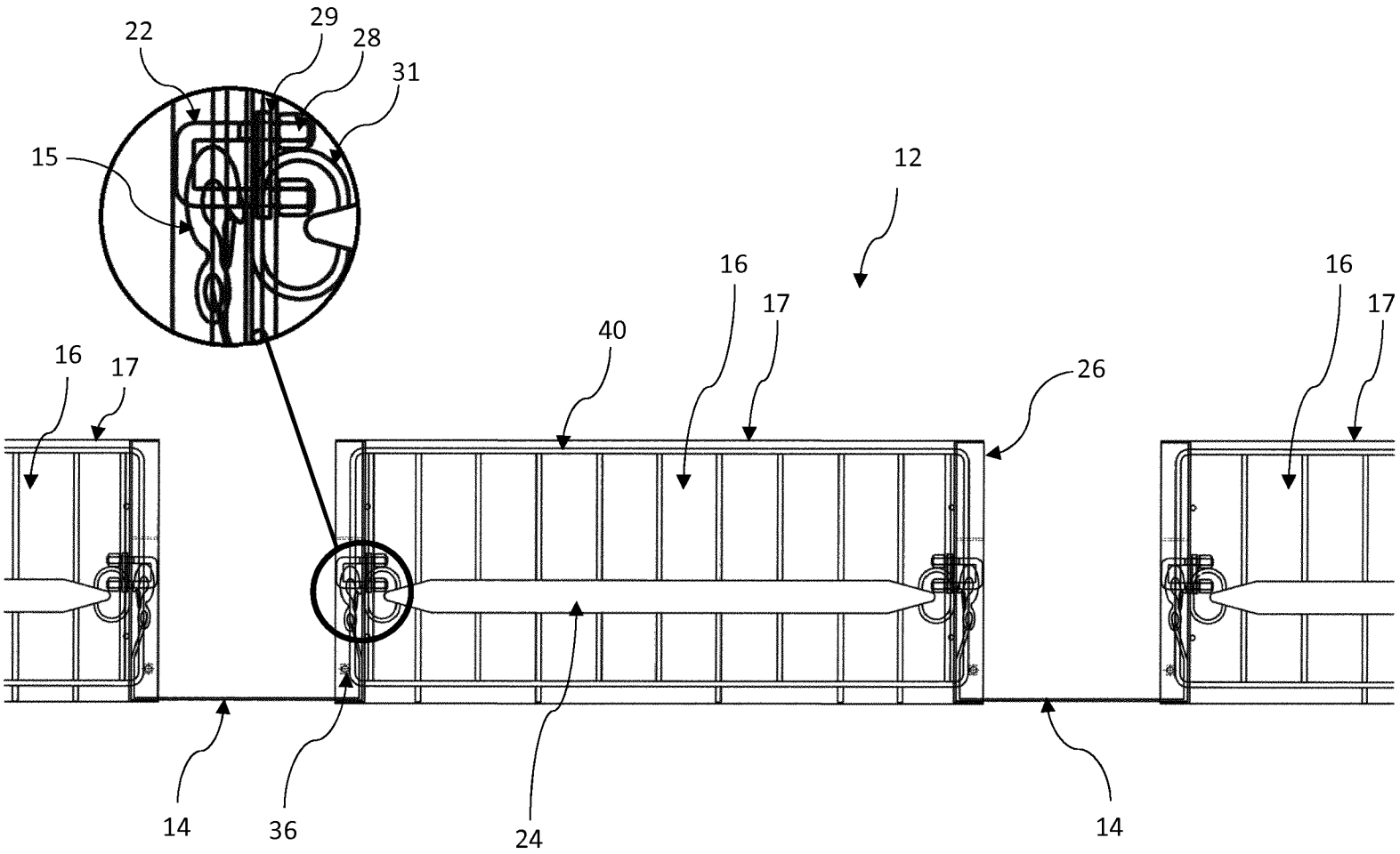
FIG. 3 shows a front view of the internal structure of linked barrier islands according to an embodiment of the invention, including an enlarged portion thereof.

Referring to FIGS. 3 to 6 the internal structure 16 of the example embodiment of the invention is shown. In FIG. 3 adjacent internal structures 16 are shown, joined by the flexible attachments 12. The flexible attachments 14 may each comprise a nylon strap having a hook 15 at either end thereof. The nylon strap may have a safe working load (SWL) of four tonnes and one or more such straps may make up each attachment. In the example embodiment two such straps, each having a length of 4 m make up each flexible attachment 14, and there are two such flexible attachments 14 extending between adjacent barrier islands giving a total SWL of 16 tonnes. As such, where a barrier island 12 is attached to an adjacent barrier island 12 on either side it will be attached to adjacent barrier islands 12 by flexible attachments 14 having a combined SWL of 32 tonnes. By safe working load what is meant is the maximum safe force that the nylon strap can be expected to lift without fear of breaking, i.e. the maximum load that it is designed to be used for. As will be well understood by the skilled person this is not the same as the breaking strength at which the nylon strap will break as a significant factor of safety will have been taken into consideration when specifying the SWL for the strap.

The concrete crash block 17 has at least one pair of opposing side faces, which are also opposing side faces 18, 20 (See FIG. 1) of the barrier island. External fixing elements 22 are provided on the opposing side faces 18, 20 of the concrete crash block 17. As show each external fixing element 22 is a U-bolt that, once the concrete crash block 17 has been cast, extends therefrom. Extending internally between the U-bolts 22 on the opposing faces are one or more load transfer element 24 which are embedded within the concrete crash block 17. Under load the load transfer elements 24 transfer load from the external fixing elements 22 on one side of the concrete crash block 17 to the external fixing elements 22 on the opposing side of said concrete crash block 17. In use, when the security barrier 10 is subject to sufficient impact to create tension in said flexible attachments 14, they transfer load between external fixing elements 22 of a barrier island without imparting a substantial tensile load on the concrete crash block 17. As concrete, relatively, is weaker under tension, and due to the high forces that occur under impact, by passing the load through specially designated components, i.e. the load transfer elements 24, the concrete is not subject to the full tensile load of the impact as the flexible attachments 14 pull tight, which otherwise could result in one or both of the external fixing elements 22 pulling out, or the concrete fracturing between the external fixing elements 22.

As shown, the longitudinal axis of each load transfer element 24 is substantially parallel to the longitudinal axis of the security barrier 10 and is also substantially perpendicular to a direction of impact protection of the security barrier. By direction of impact protection it is meant a direction from which the security barrier 10 is intended to prevent vehicular penetration.

The opposing side faces 18, 20 each have at least one recess formed therein and an external fixing element 22 is located in each recess. In the example embodiment each opposing side face 18, 20 has two recesses therein and an external fixing element 22 is located in each said recess. The recesses extend along the side faces 18, 20 to a lower edge thereof.

In the security barrier 10, one or more flexible attachment 14 which extends between external fixing elements 14 of adjacent barrier islands 12 passes from the external fixing element 14, along each said recess to the lower edge thereof, and spans the separation between said adjacent barrier islands 12 substantially along a surface on which the security barrier 10 is located. As described, above by passing the flexible attachment along the ground surface, unimpeded pedestrian access between the barrier islands 12 is enabled.

In the example embodiment each recess is formed by an impact bracket 25 which comprises a steel U-channel 26 extending vertically along each opposing side face 18, 20 from a lower edge thereof. When the crash block is cast the U-channel 26 becomes embedded in the concrete crash block so that it opens onto the side face. During casting the ends and open face of the U-channel 26 may be covered, for example with a removable tape, to prevent the concrete from filling the U-channel 26. The U-bolts that form the external fixing elements 22 pass through holes that have been drilled in the U-channel 26 prior to casting, at a position above the lower edge thereof. In the example embodiment the holes for the U-bolt are vertically spaced and the lower hole is positioned 360 mm from the lower edge of the barrier island 12. The U-bolts are then attached to the U-channel by welds 23 to hold them in place, although it will be appreciated that other methods of retaining them may be used. The two threaded ends of each U-bolt extend through the U-channel 26 and project from the rear surface thereof. A clamp plate 29 is passed over the projecting threaded ends and nuts 28 are applied to retain it in place. Prior to applying the clamp plate 29 an attachment 31 of the load transfer element 24 is placed between the clamp plate 29 and the U-channel 26 such that when the nuts 28 are tightened the load transfer element 24 and the U-bolts are attached together. In this manner any tension applied to one U-bolt, for example by the flexible attachment 14 pulling tight, is transferred from the flexible attachment 14, to the U-bolt, to the load transfer element 24 via the attachment 31, to the U-bolt on the opposing face and to the flexile attachment 14 attached to the opposing side face.

In the example embodiment the load transfer element 24 comprises a nylon webbing strap having a SWL of 4 tonnes. A small eye may be sewn on each end of the webbing strap through which the attachment 31, in the form of a metal ring, is located. The metal ring is passed between the U-bolt and the clamp plate as described above to attach the load transfer element 24 to each external fixing element 22. In the example embodiment a single such load transfer element extends between each of a pair of external fixing elements 22 on one side face and a corresponding external fixing 22 element on the opposing side face. Although, in the embodiment described, a single such nylon strap is used between opposing external fixing elements 22 it will be appreciated that multiple such nylon straps may be used between opposing external fixing elements 22, attached in the same manner. Alternatively, it will be appreciated that the load transfer elements 24 could be of any material having a suitable tensile strength, either rigid or flexible, for example other suitable material includes, without limitation: straps, cables or ropes made from metal such as steel, Kevlar, or other aramid or polymer fibres; solid metal rod or strips; and composite rods or strips.

Figure 4B:
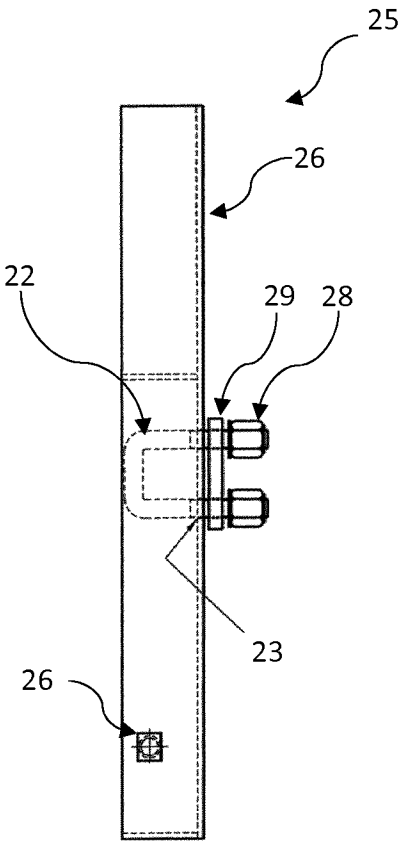
FIGS. 4*a* and 4*b* show side and front views respectively of an impact bracket of the internal structure of linked barrier islands according to an embodiment of the invention.
Figure 4A:
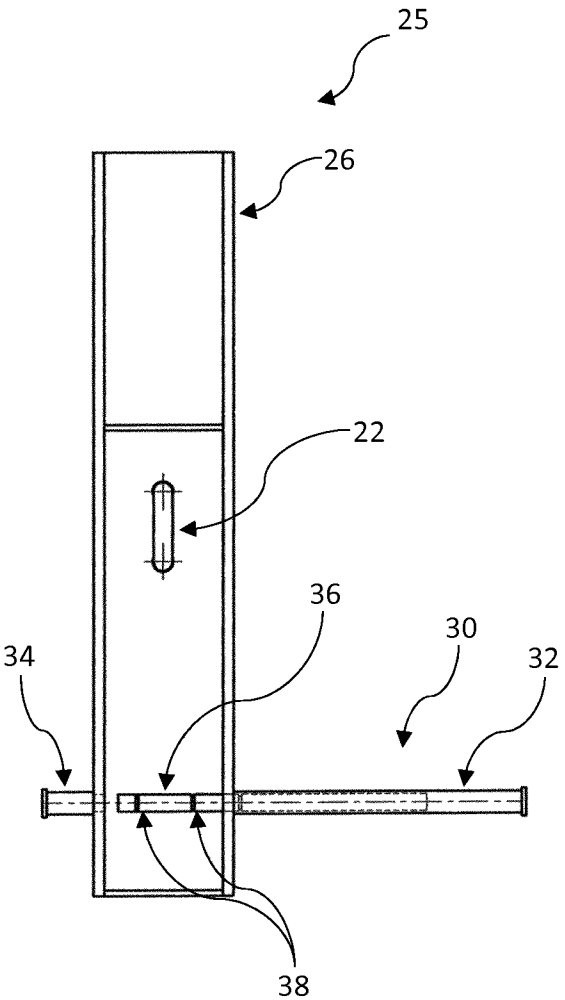
Figure 5:
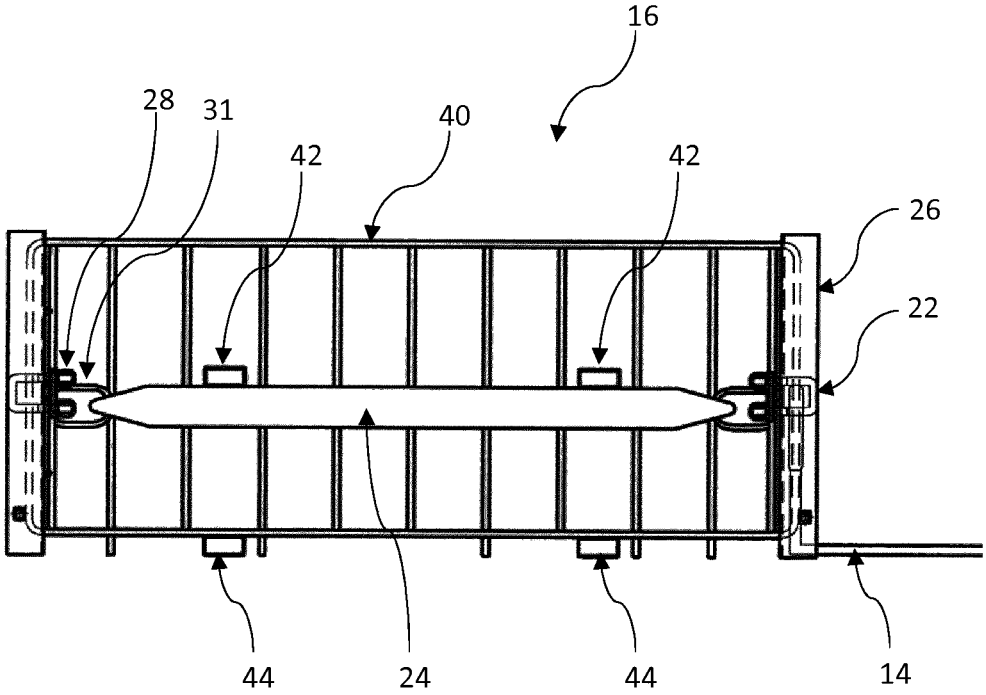
FIG. 5 shows a detailed front view of the internal structure of a single barrier island of FIG. 3 with lifting points.

As shown in FIGS. 3 and 4 a hole is provided in either side of the U-channel 26 towards the lower edge thereof and a tube 30 extends therefrom substantially perpendicular thereto in either direction. The tube 30 has a long section 32 extending towards the centre of the crash block 12 and a short section 34 extending away from the centre of the crash block 12.

The ends of the tubes are blanked of by plates welded thereto. The tubes 32, 34 may be stainless steel to prevent or minimise any corrosion thereof. A stainless-steel pin 36 is located in the long section 32 and is slidable therein such that in an extended position it spans the U-channel 26 such that it projects into the short section 34, and in a retracted position is substantially contained in the long section 32 such that it projects only a short distance therefrom. One or more grooves 38 may be cut into the pin 36 to create a weakened shear line intended to fracture under severe loading.

As shown in FIG. 3, the flexible attachment 14 passes behind the pin 36 to retain it in the recess until it is adjacent a lower end thereof, below which it may exit. Under impact, as a barrier island 10 moves, the flexible attachment 14 will pull tight against the pin 36 which will shear at the one or more grooves 38 thereby allowing the flexible attachments 14 to transfer force between external fixing elements 22 of adjacent barrier islands 12.

A cover plate (not shown) may extend over the recesses to cover the flexible attachments 14 and external fixing elements 22.

The internal structure of the barrier island 12 also includes a rebar cage 40 embedded within the concrete crash block 17 below the surface thereof. The rebar cage reinforces the concrete crash block and helps to prevent fracture of the concrete under impact.

As described above, and as shown in FIGS. 5 and 6 the barrier island 12 may have lifting points therein. These are formed as part of the internal structure 16 of the crash block by the provision of a first two lengths of box section 42 extending across the rebar cage 40 and protruding slightly from each side thereof.

The two lengths of box section 42 are dimensioned so that they are the same length as the width of the formed barrier island 12. Optionally, a second two lengths of box section 44, which may be substantially identical to the first two lengths of box section 42, may be located below the rebar cage. These second two lengths of box section 44, may form additional lifting points and/or additional fixing points for seats, benches or other furniture. The length of the first two lengths of box section 42 are such that they open onto opposing faces of the formed barrier island 12. A cover may be placed over the end of each length of box section 42 to prevent concrete entering therein during the casting of the concrete around the internal structure 16. The cover may be a bespoke cover or may for example simply be a temporary cover made of tape. After the concrete is cast the covers are removed and either disposed of or used in the fabrication of further security barriers. The second two lengths of box section 44 may be arranged in a similar manner.

Figure 7:
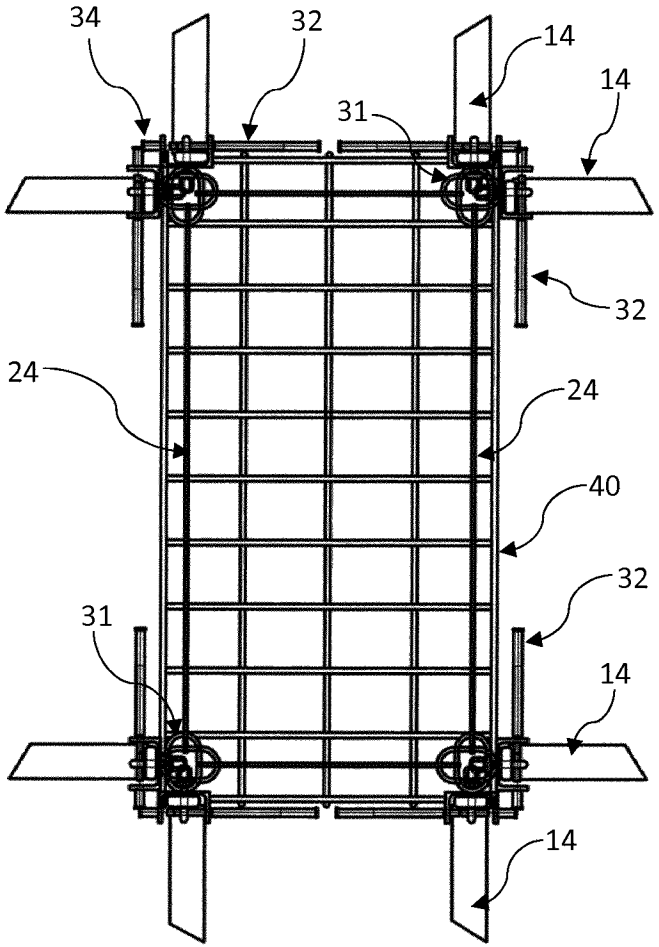
FIG. 7 shows a top view of a further embodiment of the invention.
Figure 6:
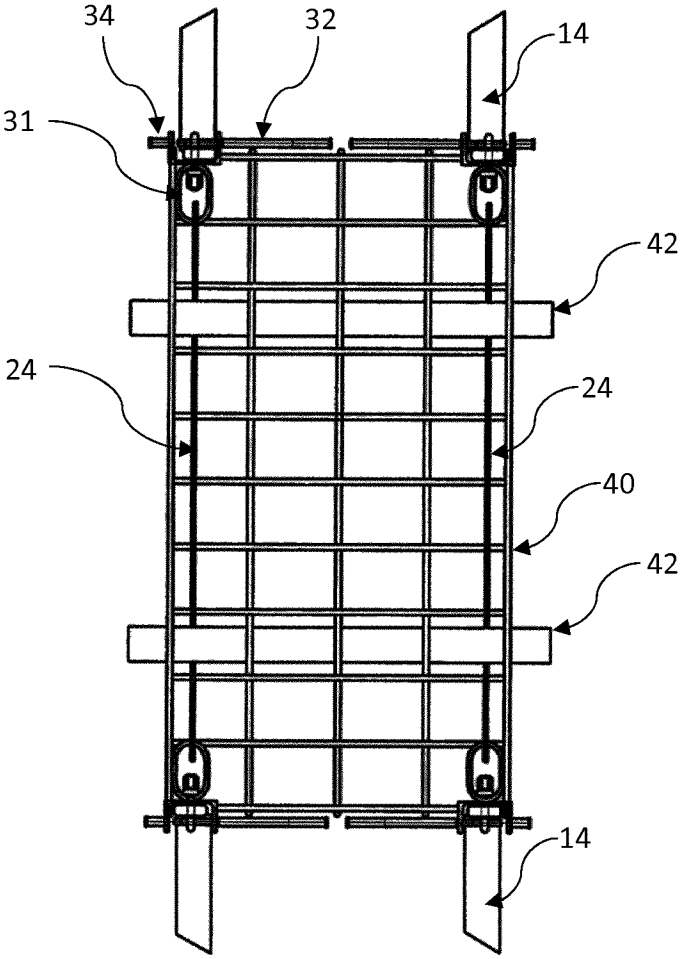
FIG. 6 shows a top view of FIG. 5.

Referring now to FIG. 7 in an embodiment a barrier island barrier of the invention may have two pairs of opposing side faces having external fixing elements 22 on opposing side faces of each pair between which one or more load transfer element 24 extends. Such a barrier island may for example be used where it is required for the security barrier 10 to form a corner. In this manner the barrier can be continuous at the corner without losing the technical benefit of the invention.

Figure 8:
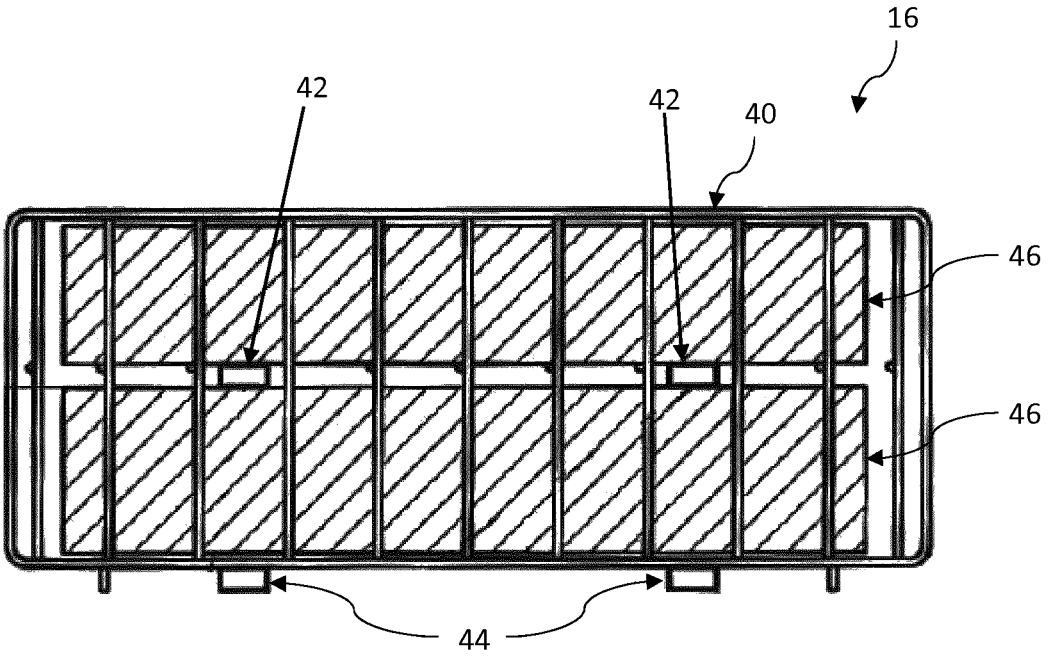
FIGS. 8 and 9 show the addition of ballast to the barrier island of the invention to increase its density (with some details omitted for clarity)
Figure 9:
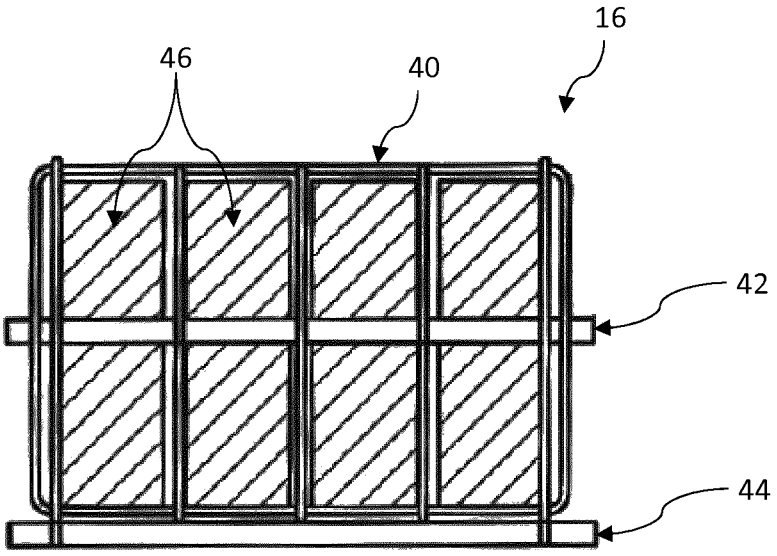

With reference to FIGS. 8 and 9 an optional feature of the invention, that can be used in combination with the example embodiment described above is shown. In these figures the U-channels 26, external fixing elements 22 and load transfer elements 24 are omitted for clarity, however it will be understood that the ballast described herein is used in combination with those features.

The barrier island 12 has additional internal structure as shown in FIGS. 8 and 9. As described above the internal structure is substantially encased in cast concrete. In the example embodiment EN206-1:2000 C30 grade concrete was used (i.e. a concrete for which the minimum compressive strength of a 300 mm long, 150 mm diameter cylinder is 30 $N/mm^2$) and the aggregate was 10 mm sized.

The additional internal structure of the barrier island 12 comprises a first and second layer of pieces of metallic ballast which are in the form of steel blocks 46 located between a top face 48 and a bottom face 50 (see FIG. 1) of the barrier island 12. In the embodiment shown the first layer comprises a first array of blocks and the second layer comprises a second array of blocks. The steel blocks 46 may comprise solid pieces of steel billet or may each comprise a plurality of strips of steel, placed adjacent one another or attached together. The barrier island 12 can have a mass in the range of 7.5 tonnes to 8.5 tonnes of which at least 5.5 tonnes are ballast. In the example embodiment the steel blocks 46 have a mass of 6000 kg (+/−10%) and the barrier island has a mass of 8000 kg (+/−10%). The pieces of metallic ballast forming the first layer may have a greater mass than the pieces of metallic ballast forming the second layer. The first layer of steel blocks may account for in excess of 60% of the mass of the metallic ballast, optionally in excess of 70% or 80%. This biasing may be achieved by using different sizes of pieces of metallic ballast in each layer, a different number of pieces of metallic ballast in each layer, or different densities of metallic ballast (i.e. different metals or alloys) in each layer. By biasing the mass of the ballast, which has a greater density than the matrix, towards the bottom of the security barrier the stability of the barrier is increased under impact.

The steel blocks 46 are substantially surrounded by the rebar cage 40 that extends below, above and around the array of steel blocks 46 and substantially adjacent to, but beneath, the respective exterior surfaces of the cast concrete that surrounds the internal structure 16. Although shown as a rectangular array, the steel blocks 46 may alternatively be arranged in a linear array, or irregularly. It will also be appreciated that although shown as rectangular blocks, alternative shaped pieces of metallic ballast can be used as described in more detail below. The steel blocks 46 are arranged in spaced relationship to one another such that, when encased in the cast concrete, the concrete passes around and between them in a continuous structure.

The additional mass achieved by using the metal ballast increases the resistance of the barrier islands to movement under impact.

Figure 10:
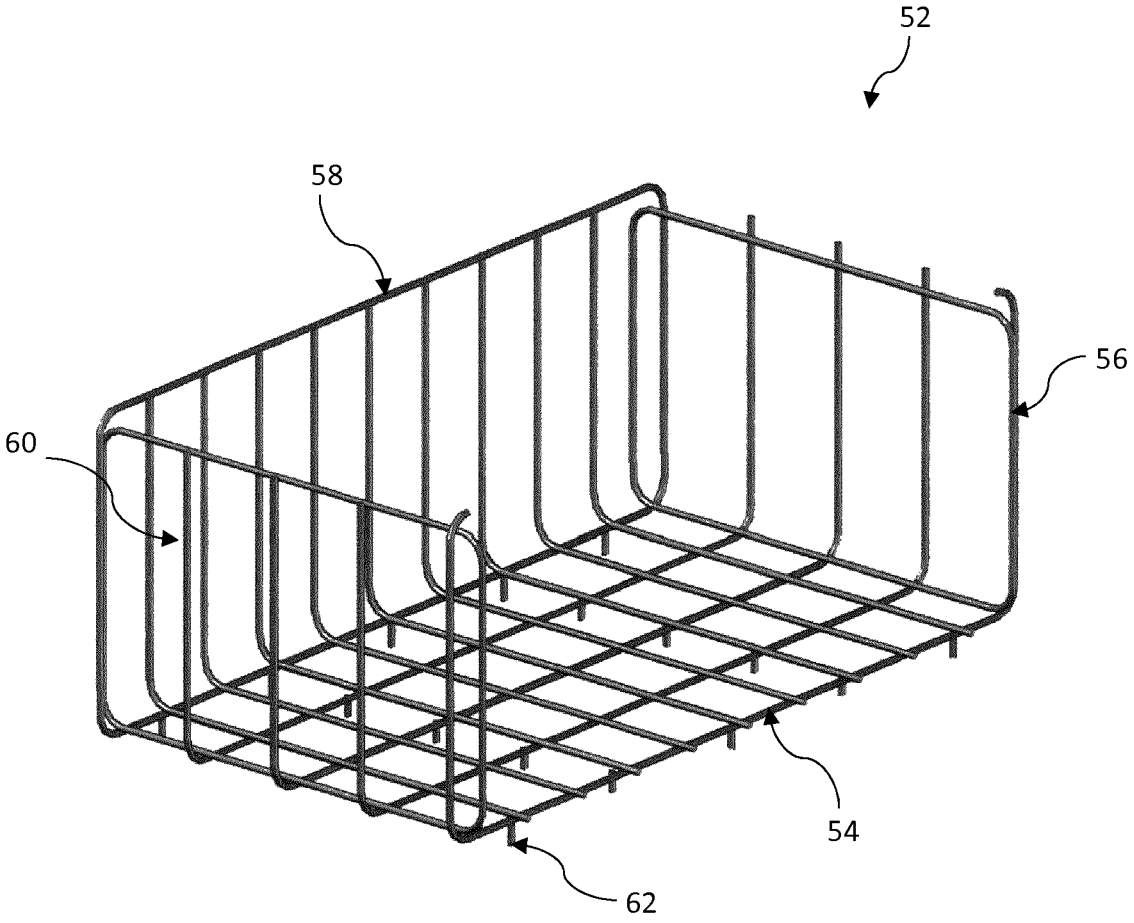
FIGS. 10 to 12 show the construction of the reinforcing rebar cage of an embodiment of the invention.
Figure 11:
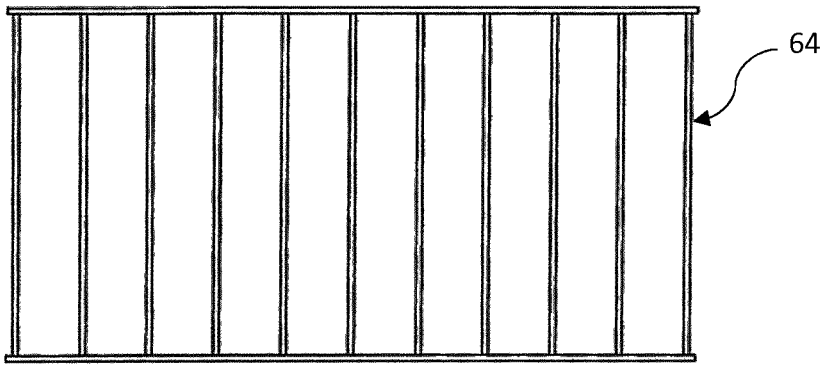
Figure 12:
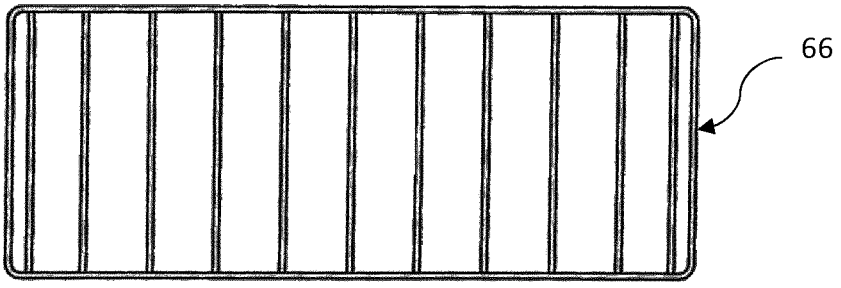

In the example embodiment a rebar cage 40 as shown in FIGS. 10 to 12 is used. The cage is made of 16 mm rebar and has overall dimensions of 1900 mm long, 1100 mm wide and 732 m high. The rebar cage 40 is made in three parts for convenience, although may be made in fewer or more parts. A first part 52 comprises a lower face 54, and three side faces 56, 58, 60 leaving one side face and the top face open. A plurality of feet 62 extend downward from the lower face 54 to, during manufacture, allow the cast concrete to fill a space below the rebar cage 40. The first part 52 may be fabricated by any known method, for example it may be fabricated by welding, brazing or tying the rebar together.

In an alternative arrangement the plurality of feet 62 may, after the barrier island 12 is formed, extend outwardly from the lower surface of the barrier island. This may be achieved by, during manufacture, placing a sheet beneath the rebar cage 40 through which the feet 62 extend so that after cast concrete is poured to form the barrier island 12 there is a space into which the concrete does not flow such that once the concrete is set the feet 62 extend therefrom. The feet may project in the region of 1 to 10 mm, optionally in the region of 3 to 5 mm. In use, when placed on a hard surface, for example concrete or tarmacadam, due to the weight of the barrier island 12, the feed will, under impact, act as "teeth" and provide very high pressure contact points which, if the barrier island 12 moves as a result of an impact, will dig into the surface on which it is situated, further impeding the movement thereof. On some very hard surfaces, for example granite, it may improve the performance if the feet 62 are tapered towards their outer ends to reduce the surface area of contact between the feet and the surface on which it is resting, thereby increasing the pressure at each foot.

Rubber or plastic caps (not shown) can optionally be fitted over the projecting metal feet 62. In use this allows the barrier islands 12 to be positioned and repositioned, by lifting and moving, on surfaces without the feet 62 causing damage. If, however, in use a barrier island 12 is struck, e.g. by a vehicle, with sufficient force to move it the pressure on the feet 62 will result in the caps being broken or torn off allowing the metal feet 62 to dig into the surface and further impede movement of the barrier island 12.

The steel blocks 46 and the lengths of box section 42 can then be located in the first part 52 of the rebar cage 40. The remaining two faces being a top face 64 (FIG. 11) and a side face 66 (FIG. 12) of the rebar cage 40 are added and fixed in place for example by welding, brazing or tying. The remaining two faces 64, 66 may be added individually or may be formed and added as a single component.

Figure 13:
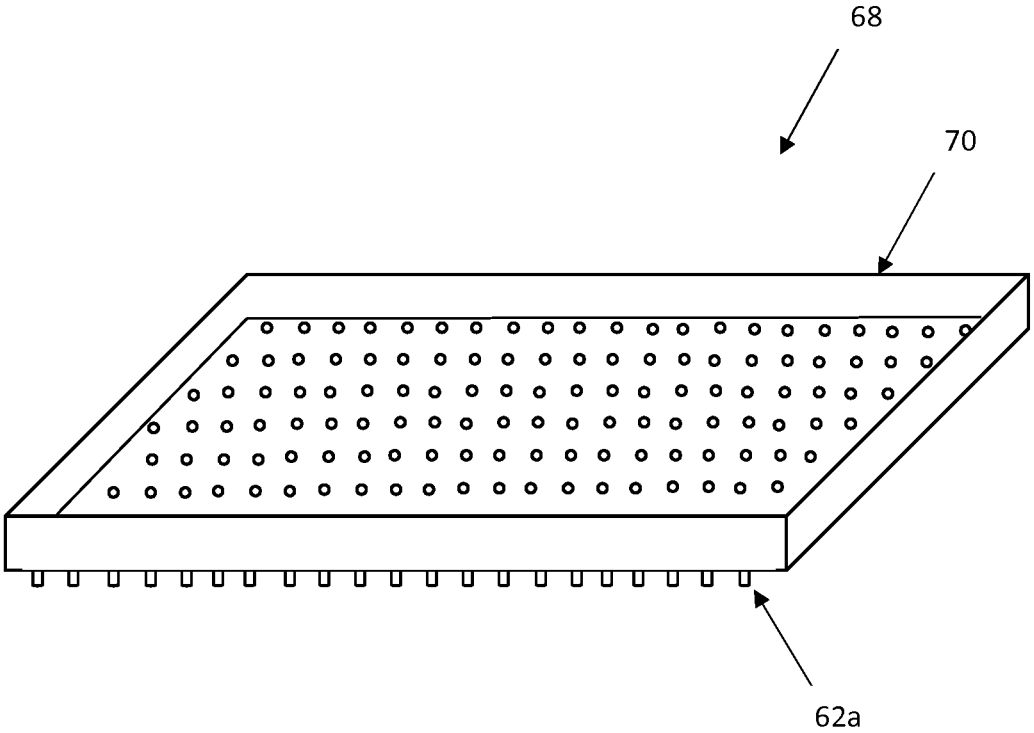
FIG. 13 shows an anti-slip plate for use with the invention

Referring now to FIG. 13 a yet further embodiment is shown. In this embodiment, instead of the projecting feet described above, a separate anti-skid plate 68 may be provided. The anti-skid plate 68 comprises a tray structure 70 and a plurality of feet 62*a*. The tray structure is welded from 10 mm mild steel and has overall dimensions to accept the barrier island 12 therein within the upstanding walls thereof. A plurality of holes are drilled in the steel plate and 20 mm steel feet 62*a* are passed through and welded flush with the upper surface thereof so that they project 10 mm from the lower surface of the tray structure 70. The manufactured barrier island 12 is then lowered into the anti-skid plate 68 and grout is applied around the edge to retain the barrier island 12 in the place. Alternatively, or in addition, the barrier island 12 may be retained in the anti-skid plate 68 by screws or bolts. As described above, rubber or plastic caps may be attached to the bottom of the feet 62*a*.

In alternative arrangements the metallic ballast may be an alternative metal to steel, for example it may be any metal having a similar or greater density. The metallic ballast may be provided in an alternative form to steel bars. In one embodiment the metallic ballast may comprise small pieces of scrap metal (e.g. steel), for example small metal discs (or similar shape) that are produced as scrap from the punching of holes in sheet metal. The small pieces may be set in a binder to hold them together, for example cement or a resin binder. Alternatively, they may be placed in containers, e.g. sheet metal troughs. In another alternative arrangement the ballast may comprise irregular shaped pieces of metal. In another embodiment the ballast may comprise small pieces of metal, for example metal shot, metal discs, or the like, mixed with the concrete prior to casting the security barrier.

It will be appreciated that the use of additional ballast as described hereinabove is an optional feature of one embodiment and the barrier islands of the invention and may be omitted in other embodiments of the invention.

Figure 14:
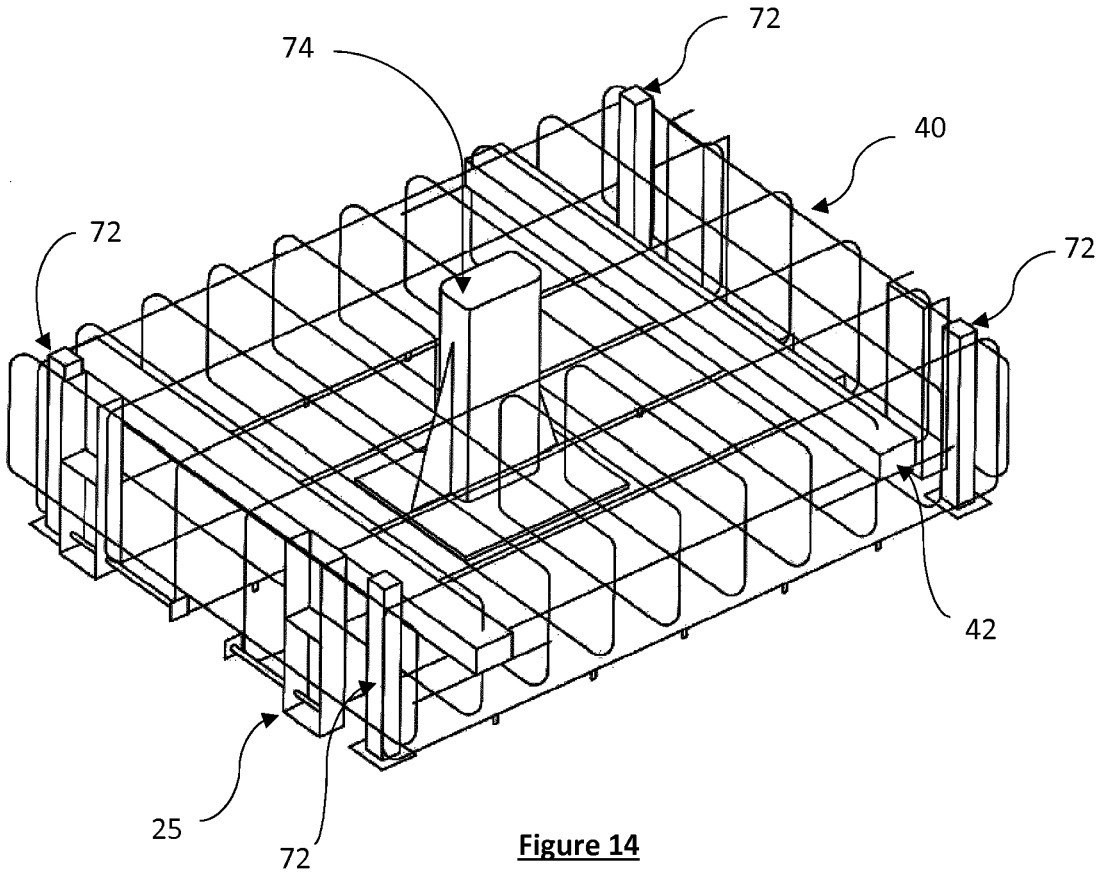
FIG. 14 shows the internal structure of an embodiment of a barrier island of the invention.
Figure 15:
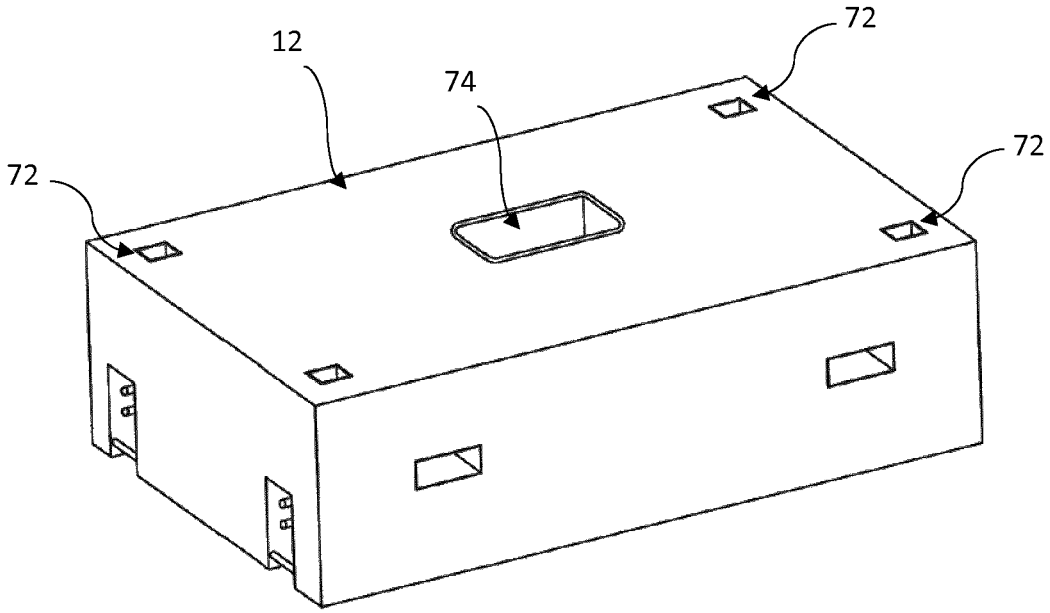
FIG. 15 shows a barrier island having the internal structure of FIG. 14.

Referring to FIGS. 14 and 15 an alternative barrier island 12 for use in a security barrier 10 of the invention is shown. FIG. 14 shows the internal metal stricture of the barrier island which comprises a rebar cage 40, lifting points comprising two lengths of rectangular box section steel 42, and impact brackets 25 as described hereinabove. It will be appreciated that prior to casting the barrier island load transfer elements 24 (not shown) would be attached to the impact brackets a described above. In addition, four fence post sockets 72 are located one at each corner of the metal structure at a position that when the barrier island is cast they open onto the upper surface thereof. The fence post sockets are made of steel box section and may be temporarily capped at their upper end during manufacture to prevent concrete ingress during casting, however it will be appreciated that other shaped fence post sockets, for example rectangular or round could also be used. In addition to the fence post sockets, a security post footing 74 as described in GB 2511273 is provided centrally in the structure, again located such that when the barrier island is cast it opens onto the upper surface thereof. FIG. 15 shows the case barrier island 12 formed by casting concrete around the structure of FIG. 14 so that it becomes embedder therein with the fence post sockets 72 and the security post footing 74 opening at the upper surface thereof.

Figure 16:
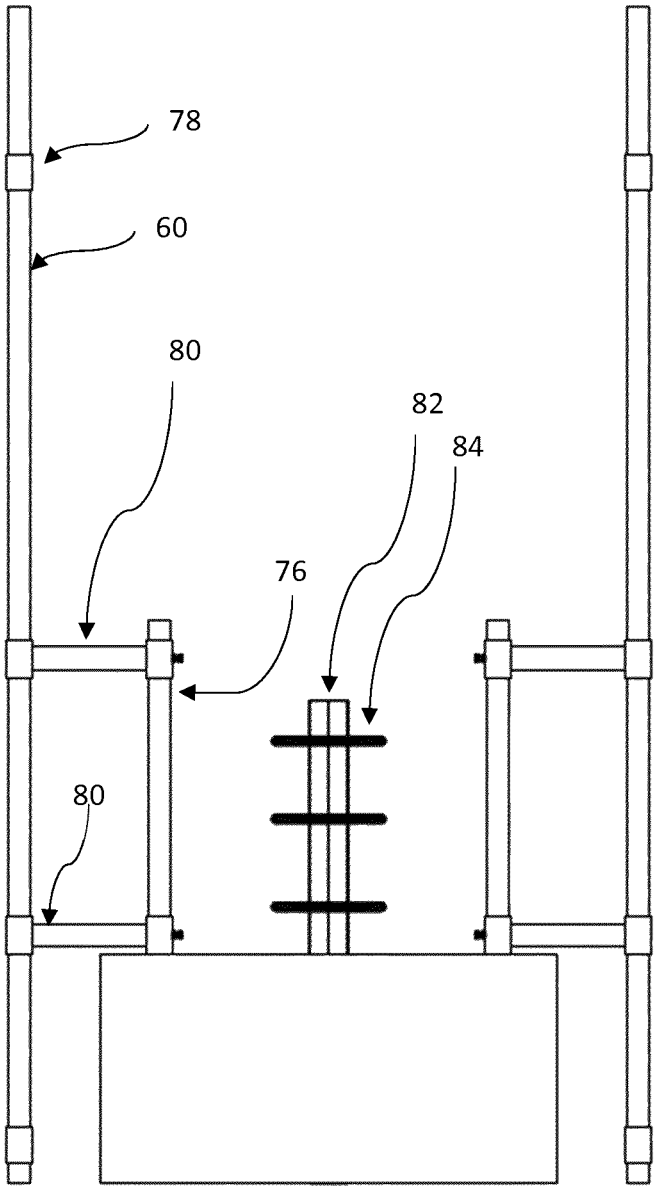
FIG. 16 shows an end view of a barrier island of FIG. 15 having fence posts and security posts attached.

Referring now to FIG. 16 a barrier island 12 as shown in FIG. 15 is shown in with fence posts 76 are inserted into the fence post sockets 72 and support posts 78 are attached to the fence posts 76 by fence spacers 80. In this way a support for a fence may be provided that extends to the ground. Although shown in both sides of the barrier island 12, it will be appreciated that in use the fence posts 76 and support posts 78 may just be provided on one side of the barrier island 12. Where a security post footing 74 is provided in the barrier island it is fitted with spring steel security posts 82. The security posts 82 can act to increase the effective height of the barrier island 12, however for enhanced protection in some applications it may be appropriate to connect security posts 82 of adjacent barrier islands 12 with one or more steel cables 84, for example as described in WO 2015/033100.

Figure 17:
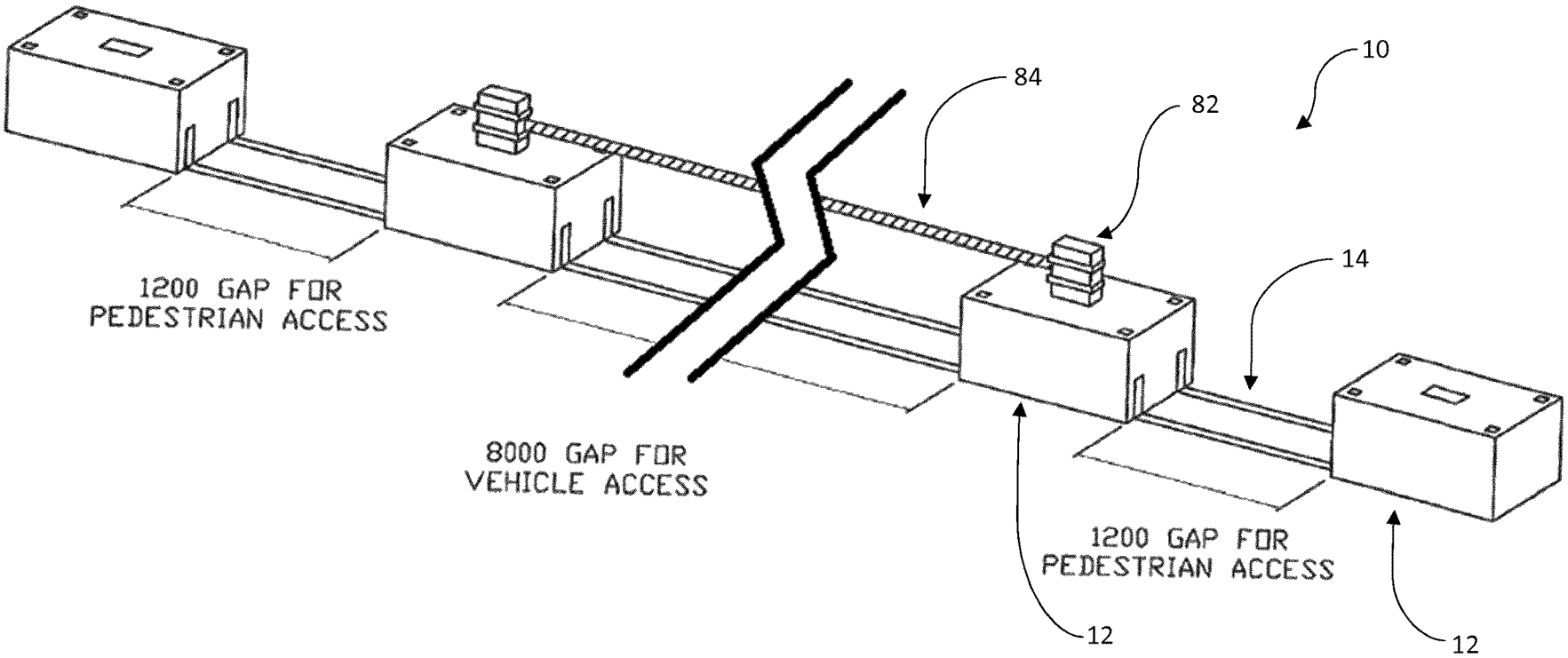
FIG. 17 shows a security barrier comprising the barrier islands of FIG. 14.

Referring to FIG. 17 an embodiment of the security barrier 10 of the invention is shown. The security barrier comprises a plurality of barrier islands 12 as described in relation to FIGS. 14 and 15 above. As can be seen the barrier islands are attached to one another by flexible attachments 14 as described above in relation to FIGS. 1 and 2. In the example embodiment the barrier island spacing is nominally 1200 mm to allow for pedestrian passage but to prevent vehicular passage. A larger separation is provided by two adjacent barrier islands 12 (the central barrier islands in the illustrated example), each of which has a security post 82 provided in the security post footing 74 thereof. An exemplary separation of 8000 mm is used in the illustrated embodiment, however different sized separations may be used provided they are sufficiently wide to allow the passage of the intended vehicles. A cable 84 is extended across the security posts 82 to prevent the passage of vehicles. When vehicular access is required the cable can be removed. Alternatively, a pivotable solid barrier, for example a steel barrier, optionally a spring steel barrier, may extend between the security posts 82.

Figure 18:
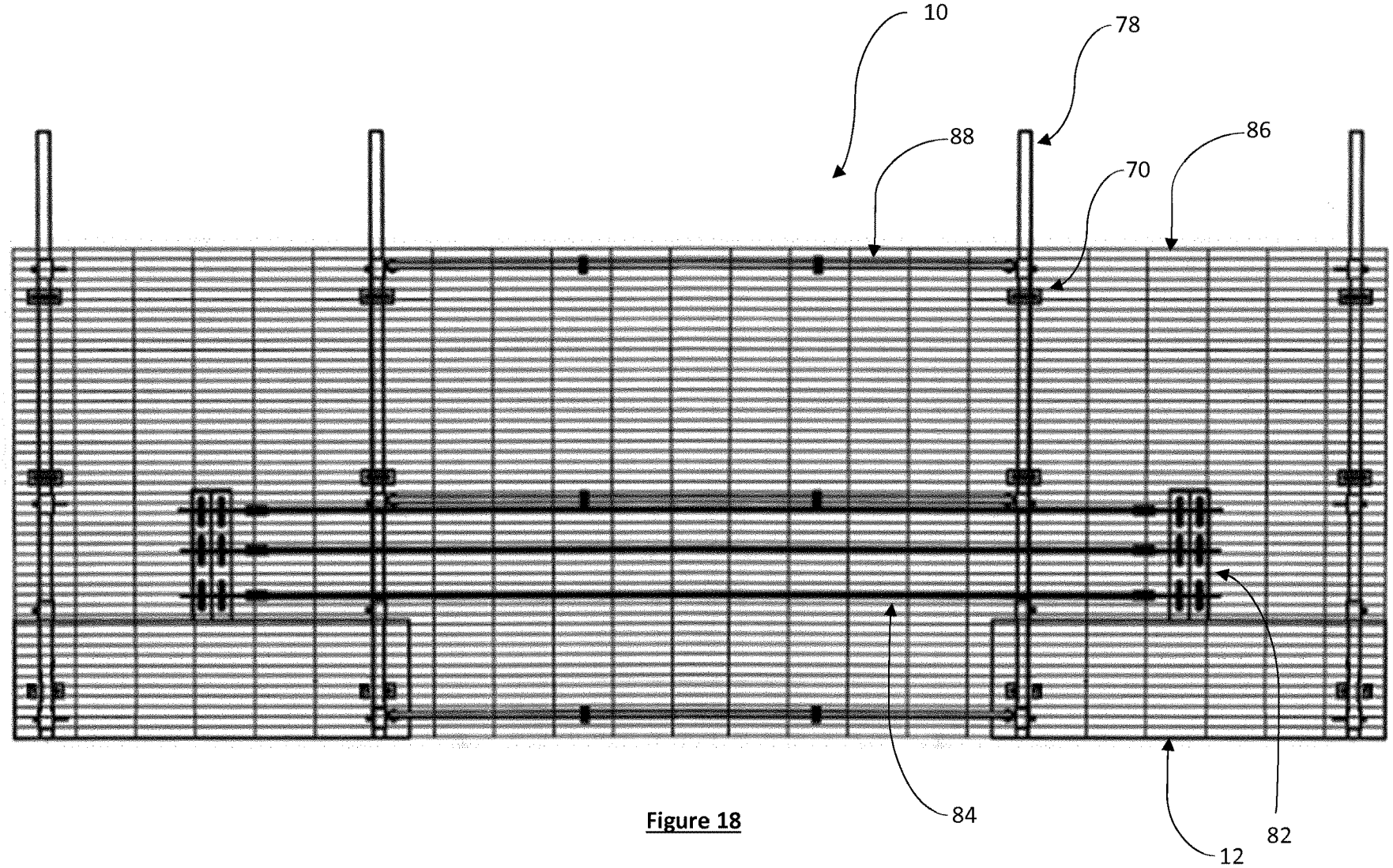
FIG. 18 shows a security barrier of the invention having a fence attached.

Referring to FIG. 18 a security barrier 10 is shown comprising adjacent barrier islands 12 as described in relation to FIGS. 14 to 16, connected by flexible attachments 14 (not shown) and having a fence post 76 located in each said fence socket 72 one side of the security barrier 10 and extending substantially vertically therefrom. Attached at one end to each fence post 76 is a pair of fence spacers 80. The fence spacers 80 are each attached at their other end to a support post 78 to which a fence panel 86 is attached. By means of the support post 78 and the fence spacers 80 the fence panel 86 is attached to the fence posts 76 located in the fence sockets 72 of barrier island 12. Although it will be appreciated that the fence panel 86 could be attached directly to the fence posts 76 the described arrangement enables the fence panels 86 to be located forward of the security barrier 10 so that they do not interfere therewith. Additional longitudinal fence braces 88 are provided extending between the support posts 78 of adjacent barrier islands 12. Although two barrier islands 12 are shown it will be appreciated that any number of the barriers islands 12 may be used to form a continuous fence. The fence panel 86 may be attached by means of simple U-bolts or other easily attachable and releasable connectors, for example zip ties. This design enables a fence to quickly be erected on the barrier islands 12 that can then provide a single, or double, pedestrian barrier as well as a vehicular barrier.

Figure 19:
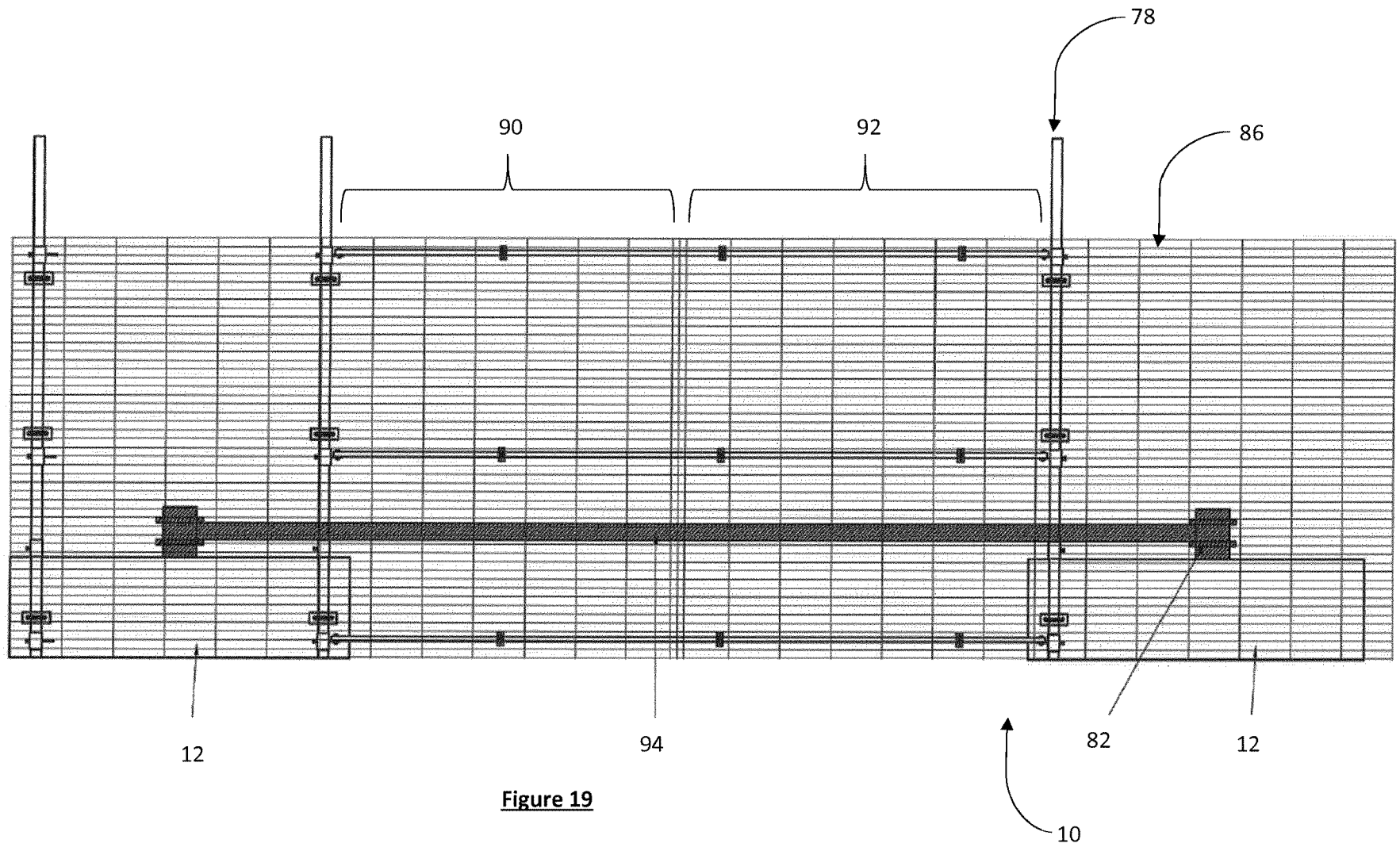
FIG. 19 shows a security barrier of the invention having a gate attached.

In addition to the fence posts, spring steel security posts 82 are provided in the embedded security post footings 74 and a plurality of wires 84 as described in WO 2015/033100 are attached between the security posts 82 of adjacent barrier islands, thereby further inhibiting vehicular passage, while allowing for a greater spacing between the security barriers Referring to FIG. 19 a variation of the embodiment of FIG. 18 is shown. In this arrangement a central section of the fence panel is split in the middle and is pivotally attached to the support posts 78 at either side to form two parts 90, 92 of an openable gate in the fence. As shown in FIG. 18 spring steel security posts 82 are provided in the embedded security post footings 74 of the barrier islands 12 on either side of the gate and a barrier is formed therebetween. In this embodiment a solid barrier 94, pivotal about one end, is provided between the security posts 82. In this manner a security barrier 10 is provided that prevents both vehicular and pedestrian access but which can be selectively opened to allow passage of both pedestrians and vehicles therethrough hen access is required.

The security barrier 10 of the example embodiment was designed and manufactured to meet the requirements of the BSI IWA14.2013 collision test. In the test the security barrier 10 is placed on top of the test surface (flat concrete) without any attachment thereto or any foundations and a 7.5 tonne truck is then collided with the security barrier 10 travelling at 64 kph (40 mph).

It will be appreciated that the embodiment described herein is given as an example of the invention and that various changes and modifications can be made to the present invention without departing from the scope of the present application.

The invention claimed is:

1. A surface mount security barrier comprising:

a plurality of barrier islands arranged in spaced relation to one another, each barrier island comprising: a concrete crash block having at least one pair of opposing side faces;

external fixing elements at said opposing side faces of the concrete crash block, and one or more load transfer element embedded internally within said concrete crash block; and one or more attachments extending between external fixing elements of adjacent barrier islands, wherein, under load, said load transfer elements transfer load through the concrete crash block from the external fixing elements on one side of said concrete crash block to the external fixing elements on the opposing side of said concrete crash block, wherein said attachments are flexible attachments which, in use, extend only along the ground across the space between said adjacent barrier islands, and wherein said load transfer elements of a said barrier island are attached at either end to a said external fixing element of the concrete crash block in which they are embedded.

2. The surface mount security barrier according to claim 1 wherein the load transfer elements are configured such that, when the security barrier is subject to sufficient impact to create tension in said flexible attachments, the load transfer elements transfer load between external fixing elements of a barrier island without imparting a tensile load on the concrete crash block.

3. The surface mount security barrier according to claim 1 wherein a longitudinal axis of each said one or more load transfer element is substantially parallel to the longitudinal axis of said security barrier and/or wherein a longitudinal axis of each said one or more load transfer element is substantially perpendicular to a direction of impact protection of said security barrier.

4. The surface mount security barrier according to claim 1 wherein each said load transfer element and/or each said attachment comprises one or more nylon strap.

5. The surface mount security barrier according to claim 1 wherein said concrete crash block comprises two pairs of opposing side faces, and wherein one or more load transfer element extends between external fixing elements on opposing side faces of each said pair.

6. The surface mount security barrier according to claim 1 wherein said opposing side faces have at least one recess therein and a said external fixing element is located in said recess or wherein said opposing side faces each have two recesses therein and an external fixing element is located in each said recess.

7. The surface mount security barrier according to claim 6 wherein each said recess extends along said opposing side face to a lower edge thereof.

8. The surface mount security barrier according to claim 7 further comprising a pin extending across said recess substantially adjacent the lower edge.

9. The surface mount security barrier according to claim 7 wherein, said one or more attachments are flexible attachments extending between external fixing elements of adjacent barrier islands pass along each said recess to the lower edge and span a separation between said adjacent barrier islands substantially only along a surface on which the security barrier is located.

10. The surface mount security barrier according to claim 9 further comprising a pin extending across said recess substantially adjacent the lower edge wherein said flexible attachment passes behind said pin.

11. The surface mount security barrier according to claim 6 wherein each said recess comprises a metal U-channel extending vertically along a said opposing side face from a lower edge thereof, said U-channel embedded in said concrete crash block and opening onto said side face and wherein said external fixing element extends through said U-channel at a position above said lower edge.

12. The surface mount security barrier according to claim 11 further comprising a pin extending across said recess substantially adjacent the lower edge, a hole in said U-channel and a tube extending therefrom, wherein said pin is slidable in said tube through said hole.

13. The surface mount security barrier according to claim 1 further comprising metallic ballast within said concrete crash block.

14. The surface mount security barrier according to claim 1 comprising one or more lifting points embedded in therein wherein said lifting points comprises two or more box sections extending through the concrete crash block and opening on opposing surfaces thereof.

15. The surface mount security barrier according to claim 1 wherein the barrier islands each comprise a plurality of feet extending from a bottom surface thereof.

16. The surface mount security barrier of claim 1 further comprising one or more fence post holes extending downwardly into a top surface of each barrier island.

17. The surface mount security barrier according to claim 16 further comprising, a fence post located in one or more fence post holes in adjacent barrier islands, and at least one fence panel attached to fence posts of said adjacent barrier islands, or at least one openable gate attached to said fence posts of said adjacent barrier islands.

18. The surface mount security barrier of claim 1 further comprising one or more security post footing extending downwardly into a top surface thereof, said security post footing for receiving, in use a security post.

19. The surface mount security barrier according to claim 18 further comprising, a spring steel security post located in the security post footing of adjacent barrier islands and a further security barrier comprising either one or more flexible barrier or a rigid barrier extending between the security posts of said adjacent barrier islands, and wherein said flexible or rigid barrier is either permanently attached to said security posts, or is releasable from said security posts to create an openable barrier.

* * * * *